US007806707B1

(12) United States Patent
Lai

(10) Patent No.: US 7,806,707 B1
(45) Date of Patent: Oct. 5, 2010

(54) SOCKET PROTECTION COVER STRUCTURE

(76) Inventor: Li-Chun Lai, 21F-1, No. 33, Sec 1, Minsheng Rd., Panciao City, Taipei County (TW)

( * ) Notice: Subject to any disclaimer, the term of this patent is extended or adjusted under 35 U.S.C. 154(b) by 0 days.

(21) Appl. No.: 12/179,619

(22) Filed: Jul. 25, 2008

(51) Int. Cl.
*H01R 13/44* (2006.01)

(52) U.S. Cl. ..... 439/145

(58) Field of Classification Search ..... 439/142, 439/145, 135, 139, 136, 652, 367, 371; 174/67
See application file for complete search history.

(56) References Cited

U.S. PATENT DOCUMENTS 5,011,419 A * 4/1991 Maan ..... 439/145
5,997,318 A * 12/1999 Chou ..... 439/136
5,997,319 A * 12/1999 Wu ..... 439/143
6,602,081 B1 * 8/2003 Wang ..... 439/145
6,767,229 B1 * 7/2004 Wang ..... 439/145
6,776,630 B1 * 8/2004 Huang ..... 439/137
6,984,139 B1 * 1/2006 Lai ..... 439/142
7,458,831 B2 * 12/2008 Okada et al. ..... 439/139
7,510,412 B1 * 3/2009 Valentin ..... 439/145
2004/0203270 A1 * 10/2004 Wang ..... 439/136

* cited by examiner

*Primary Examiner*—Alexander Gilman

(57) ABSTRACT

A socket protection cover structure includes a socket body having a socket panel disposed thereon, the socket panel is disposed with two holes corresponding to each other for a sliding slot and a plurality of positioning holes to be disposed therebetween; a sliding cover having a pivot inserted through the sliding slot of the socket panel for the sliding cover to move on the socket panel; therefore an operator can use the sliding cover to expose or enclose the hole on the socket panel to enhance safety use of electricity.

6 Claims, 3 Drawing Sheets

SOCKET PROTECTION COVER STRUCTURE

BACKGROUND OF THE INVENTION

1. Field of the Invention

The present invention relates to a socket protection cover structure, and more particularly, to a socket protection cover structure using a sliding cover to enclose a hole of a socket panel to avoid electrical leakage and to provide safety use.

2. Description of the Prior Art

Traditionally there are fixed type sockets and extended type sockets (or extension wires) for electrical appliances; fixed type sockets are usually implemented in the wall for providing electricity to common home appliances; while extension wires are broadly applied to compliment the fixed type sockets or provided for outdoor use. However, fixed type sockets and extension wires are implemented with their socket holes exposed outwardly even when the sockets are not in use, therefore impurities and wet substances are very likely to permeate or enter the socket holes, thus causing possibilities of electrical leakage or electric shock to users; besides, a child will be harmed if the child sticks his/her finger into the exposed socket hole. Hence, it is urgent and critical to provide a safety design for the socket so as to enclose the holes when the socket is not in use.

Therefore, the traditional sockets present several shortcomings to be overcome.

In view of the above-described deficiencies of the traditional sockets, after years of constant effort in research, the inventor of this invention has consequently developed and proposed a socket protection cover structure in the present invention.

SUMMARY OF THE INVENTION

It is an object of the present invention to provide a socket protection cover structure which can enclose the hole of the socket body when the socket body is not in use to avoid wet substances and impurities from entering the hole of the socket to prevent electrical leakage.

It is another object of the present invention to provide a socket protection cover structure which comprises a sliding cover having a pivot provided in cylindrical shape, the pivot is thus designed to let the stress generated during the combination of the sliding cover and the socket body be evenly distributed to avoid breaking the socket protection cover structure and to enhance the lifetime of the sliding cover.

The present invention discloses a socket protection cover structure, which comprises a socket body and a sliding cover; the surface of the socket body is a socket panel, which comprises two holes corresponding to each other for receiving a plug of a home appliance, and a sliding slot and a plurality of positioning holes disposed between the two holes; a pivot extends from a bottom of the sliding cover, with positioning blocks protruding from each side of the pivot and corresponding to each other, and an opening is also disposed on the sliding cover; the pivot of the sliding cover is inserted through the sliding slot of the socket panel for combining the positioning blocks with the positioning holes of the socket panel to hold the sliding cover on the socket panel and to let the sliding cover move back and forth on the socket panel. When a user wants to use the socket, he/she can push the sliding cover for a distance to let the opening of the sliding cover correspond to one of the holes of the socket panel. At this time the two holes on the socket panel are both exposed for insertion of a plug. When the user pulls out the plug from the socket body, he/she can push the sliding cover reversely to let the sliding cover enclose the two holes on the socket panel to avoid impurities or wet substances attaching or entering the holes to cause short circuit or electric shock, thereby providing safety use of the socket.

These features and advantages of the present invention will be fully understood and appreciated from the following detailed description of the accompanying Drawings.

DETAILED DESCRIPTION OF THE PREFERRED EMBODIMENT

Figure 1:
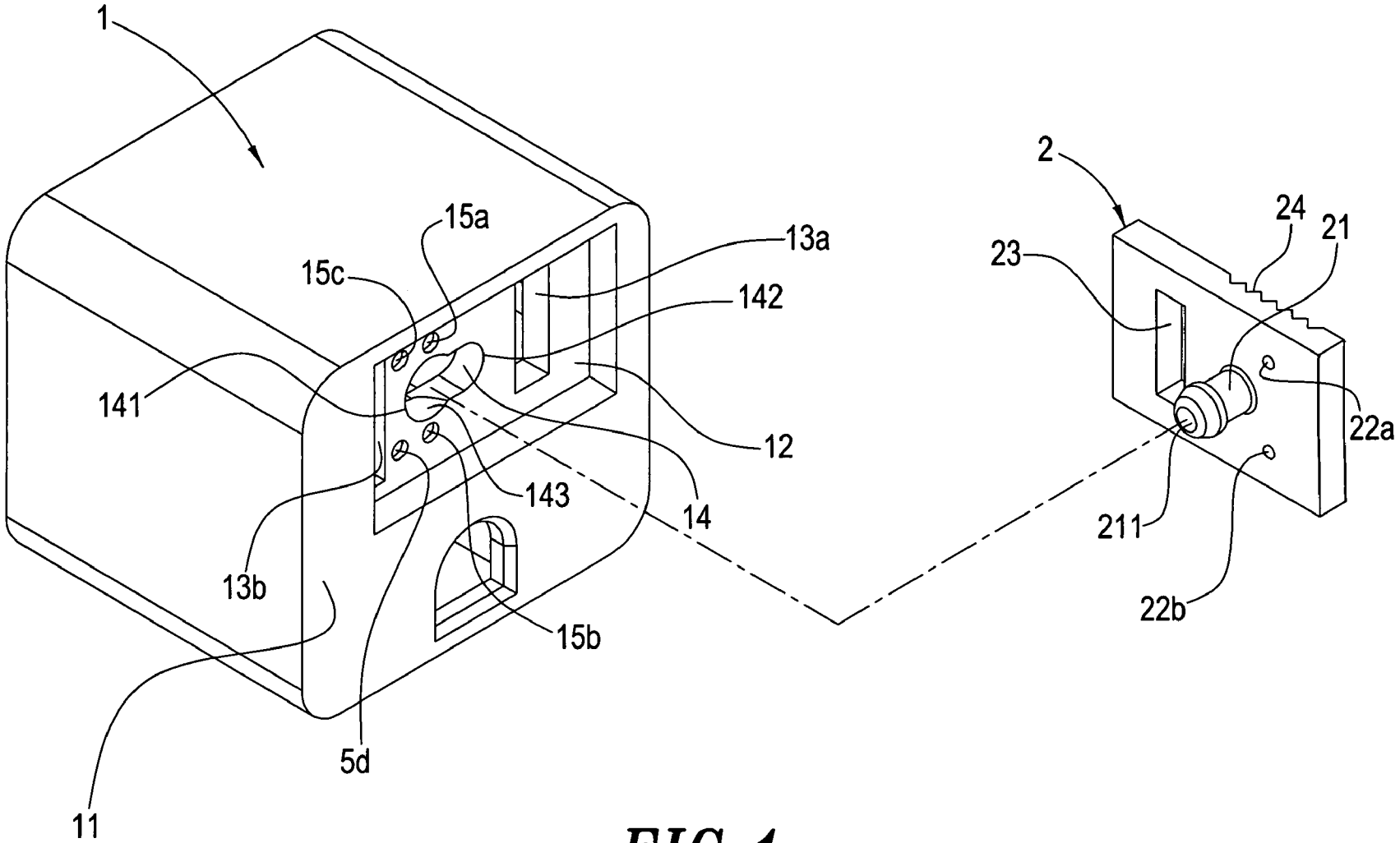
FIG. 1 illustrates a perspective view of a socket protection cover structure in the present invention.
Figure 2:
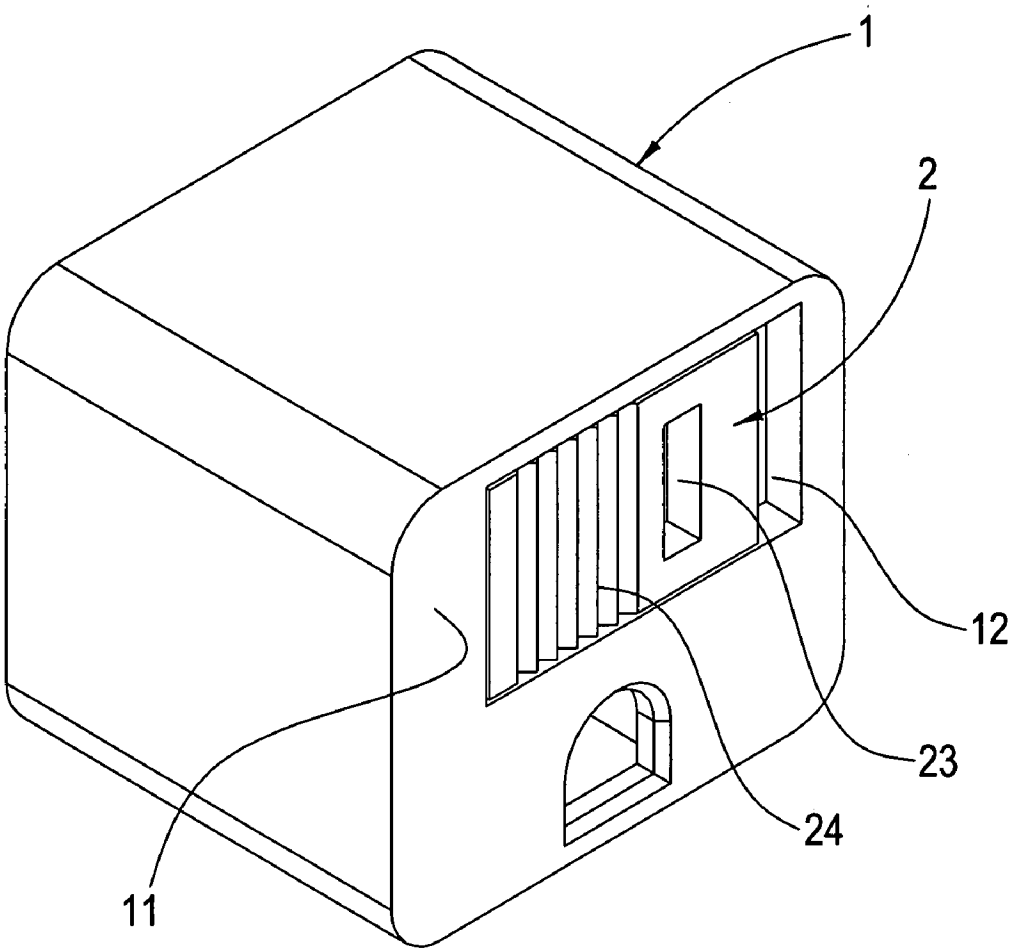
FIG. 2 illustrates a perspective view of the socket protection cover structure.

Please refer to FIG. 1 and FIG. 2 for the socket protection cover structure disclosed in the present invention, which mainly comprises a socket body and a sliding cover.

The socket body 1 comprises a socket pane 111, wherein the socket pane 111 comprises a concave portion 12 disposed thereon. Two holes 13*a*, 13*b* corresponding to each other are disposed on the concave portion 12, and a sliding slot 14 is disposed between the two holes 13*a*, 13*b*, the sliding slot 14 comprises a first end portion 141 and a second end portion 142. The first end portion 141 comprises an angled inclined plane 143 on its top surface provided that the angled inclined plane doesn't affect the aperture of the sliding slot 14, and the sliding slot 14 of the socket panel 111 preferably comprises two positioning holes 15*a*, 15*b* on one side corresponding to two positioning holes 15*c*, 15*d* on the other side of the sliding slot 14 of the socket panel 111.

The sliding cover 2 comprises a pivot 21 extending from the bottom thereof, with a rim 211 extending from an end portion of the pivot 21. Two positioning blocks 22*a*, 22*b* and an opening 23 are disposed on each side of the pivot 21 respectively, with anti-slip stripes 24 disposed on the front surface of the sliding cover 2. Besides, the length of the sliding cover 2 is shorter than that of the concave portion 12 of the socket panel 111, and the width of the sliding cover 2 is slightly shorter than or equal to that of the concave portion 12 of the socket pane 111.

When the sliding cover 2 is combined with the concave portion 12 of the socket pane 111, the rim 211 on the end portion of the pivot 21 of the sliding cover 2 is guided by the angled inclined plane 143 of the first end portion 141 of the sliding slot 14 of the socket pane 111 to go through the sliding slot 14 and enter the socket body 1 to let the sliding cover 2 be stuck in the concave portion 12 of the socket pane 111 and be near the same level with the surface of the socket pane 111. Since the length of the sliding cover 2 is shorter than that of the concave portion 12 of the socket pane 111, the sliding cover 2 can move back and forth in the concave portion 12, while two positioning blocks 22*a*, 22*b* on the bottom of the sliding cover 2 are to be stuck in the two positioning holes 15*c*, 15*d* of the socket pane 111 to fix the sliding cover 2.

Figure 3A:
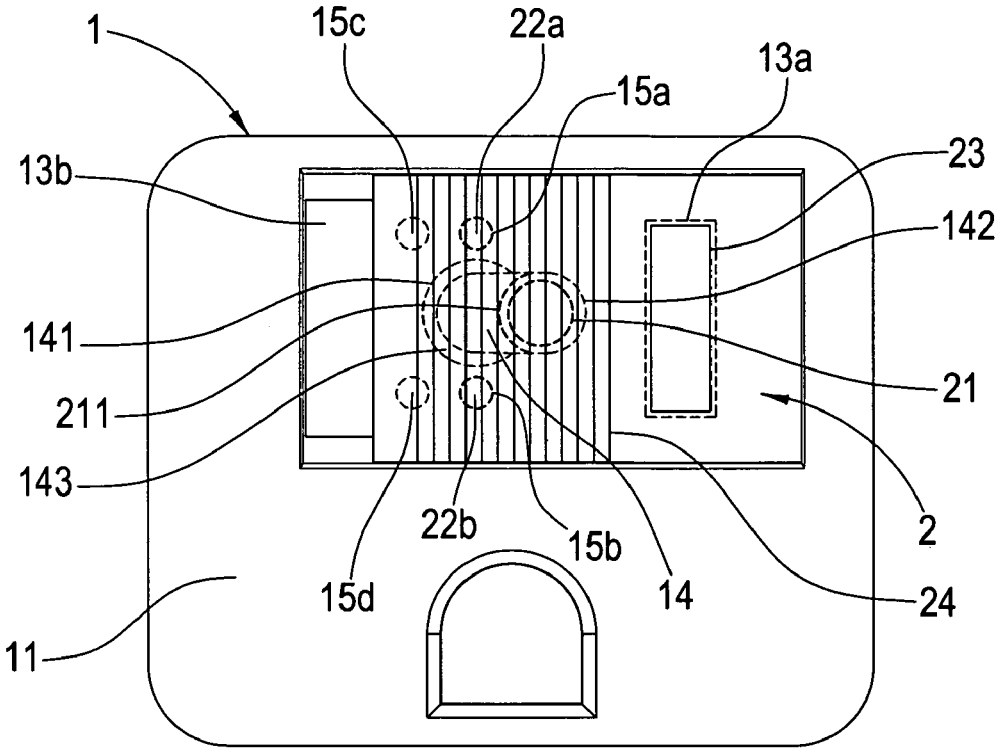
FIGS. 3A and 3B illustrate the operations of the socket protection cover structure.
Figure 3B:
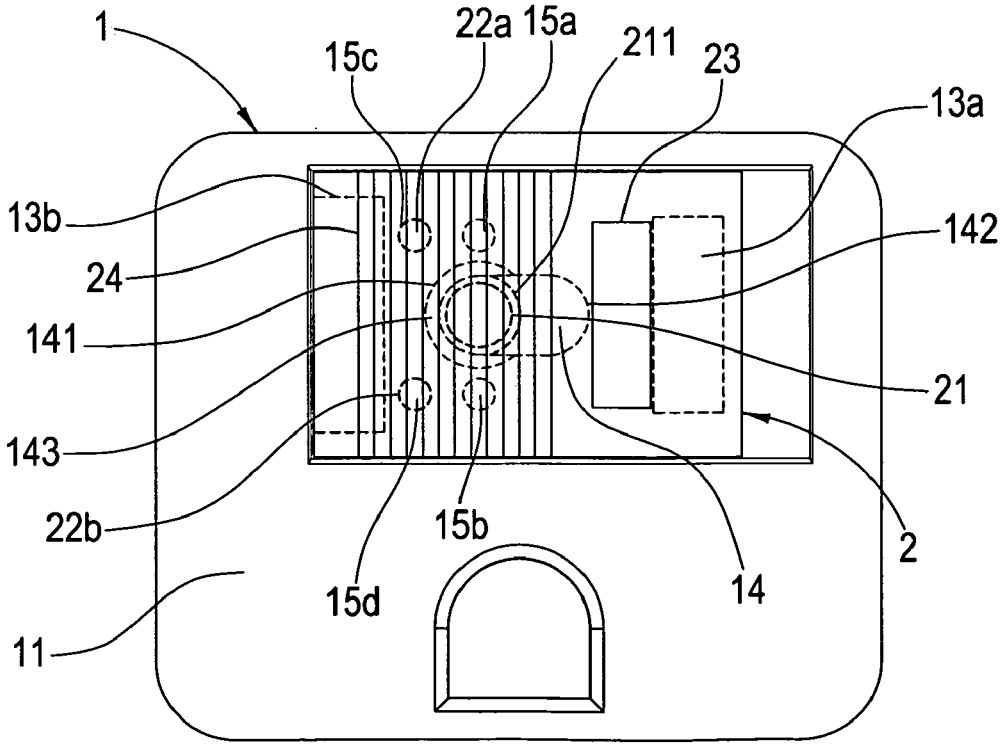

Please refer to FIGS. 3A and 3B for the operations of the present invention. As shown in FIG. 3A, when a user wants to use the socket body 1, he/she can use the anti-slip stripes 24 on the front surface of the sliding cover 2 to push the sliding cover 2 for a distance to let the pivot 21 of the sliding cover 2 move from the first end portion 141 of the sliding slot 14 of the socket pane 111 to the second end portion 142, with the two positioning blocks 22*a*, 22*b* of the sliding cover 2 sticking with the two positioning holes 15*a*, 15*b* of the socket pane 111 to hold the sliding cover 2 in position. At this time the hole 13*b* of the socket pane 111 is not covered by the sliding cover 2, and the other hole 13*a* corresponds to the opening 23 of the sliding cover 2 to let the two holes 13*a*, 13*b* of the socket pane 111 expose for receiving a plug of a home appliance. When the user pulls out the plug from the socket body 1, he/she can push the sliding cover 2 reversely to let the pivot 21 of the sliding cover 2 move from the second end portion 142 of the sliding slot 14 back to the first end portion 141, with the two positioning blocks 22*a*, 22*b* of the sliding cover 2 sticking with the two positioning holes 15*c*, 15*d* of the socket pane 111 to hold the sliding cover 2 in position and to enclose the two holes 13*a*, 13*b* of the socket pane 111, by doing so it is viable to avoid impurities or wet substances attaching or entering the holes to cause short circuit or electric shock, thereby providing safety use of the socket.

Besides, in the preferred embodiment, there are four positioning holes 15*a*, 15*b*, 15*c*, 15*d* disposed on the socket pane 111 and two positioning blocks 22*a*, 22*b* disposed on the sliding cover 2, however, the number of the positioning hole and the positioning block are not limited thereto. It is possible to change the number of the positioning hole and the positioning block according to real world requirements.

The present invention provides a socket protection cover structure, while compared to other traditional socket structures, is advantageous in:

1. The present invention provides a socket protection cover structure which can enclose the hole of the socket body when the socket body is not in use to avoid wet substances and impurities from entering the hole of the socket to prevent electrical leakage.

2. The present invention provides a socket protection cover structure which comprises a sliding cover having a pivot provided in cylindrical shape, and the pivot is thus designed to let the stress generated during the combination of the sliding cover and the socket body be evenly distributed to avoid breaking the socket protection cover structure and to enhance the lifetime of the sliding cover.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A socket protection cover structure, comprising:

a socket body having a socket panel with two holes corresponding to each other disposed thereon, and a sliding slot disposed between the two corresponding holes, the sliding slot having a first end portion and a second end portion, with two or more than two positioning holes disposed on both sides of the sliding slot of the socket panel; and a sliding cover, having a pivot extending from a bottom thereof, a rim extending from an end portion of the pivot, an opening and at least one positioning block being disposed on each of both sides of the pivot;

when the rim of the pivot of the sliding cover is inserted through the sliding slot of the socket panel to enter the socket body, each one of the positioning blocks on the bottom of the sliding cover is to be stuck in one of the positioning holes of the socket panel to hold the sliding cover in position.

2. The socket protection cover structure of claim 1, wherein the socket panel comprises a concave portion disposed thereon for receiving the two holes, the sliding slot and the two or more than two positioning holes in the concave portion.

3. The socket protection cover structure of claim 1, wherein the first end portion of the sliding slot of the socket panel comprises an angled inclined plane on a top surface thereof, provided that the angled inclined plane doesn't affect an aperture of the sliding slot, and the angled inclined plane is provided for leading the rim of the pivot of the sliding cover to be inserted through the sliding slot.

4. The socket protection cover structure of claim 1, wherein the socket panel preferably comprises two positioning holes on one side corresponding to two positioning holes on the other side of the socket panel.

5. The socket protection cover structure of claim 1, wherein the sliding cover comprises anti-slip stripes disposed on a front surface thereof to facilitate movement of the sliding cover.

6. The socket protection cover structure of claim 1, wherein two positioning blocks on the bottom of the sliding cover are preferred.

* * * * *